United States Patent [19]

Iwahashi et al.

[11] Patent Number: 5,066,384

[45] Date of Patent: Nov. 19, 1991

[54] PROCESS FOR REFINING COAL-DERIVED HEAVY CARBONACEOUS MATERIALS

[75] Inventors: Tohru Iwahashi; Yoshihiko Sunami, both of Ibaraki; Katsumi Satoh, Tokyo; Katsuyuki Ohshima, Ibaraki; Kenichi Iwaguro, Funabashi, all of Japan

[73] Assignees: Sumitomo Metal Industries, Ltd., Osaka; Sumikin Chemical Co. Ltd.; Kureha Kagaku Kogyo Kabushiki Kaisha, both of Tokyo, all of Japan

[21] Appl. No.: 162,248

[22] Filed: Feb. 29, 1988

Related U.S. Application Data

[63] Continuation of Ser. No. 37,999, Apr. 14, 1987, abandoned, which is a continuation of Ser. No. 832,704, Feb. 25, 1986, abandoned.

[30] Foreign Application Priority Data

Feb. 28, 1985 [JP] Japan ..... 60-039349

[51] Int. Cl.[5] ..... C10C 1/18

[52] U.S. Cl. ..... 208/45; 208/309

[58] Field of Search ..... 208/45, 309

[56] References Cited

U.S. PATENT DOCUMENTS 4,259,171 3/1981 Stadelhofer et al. ..... 208/45

4,402,824 9/1983 Sunami et al. ..... 208/45

*Primary Examiner*—Asok Pal

*Attorney, Agent, or Firm*—Burns, Doane, Swecker & Mathis

[57] ABSTRACT

A process for refining coal-derived heavy carbonaceous materials such as pitch to remove quinline insolubles therefrom is disclosed. The process comprises providing a coal-derived heavy carbonaceous material from which all the components having normal boiling points of 270° C. or below and all or part of the components having normal boiling points ranging from 270° C. to 360° C. have been removed; heating the heavy carbonaceous material to make it fluid; mixing the heated carbonaceous material with a ketone solvent having a boiling point below 200° C. for a period sufficient to precipitate coarse insoluble particles in the mixture; separating the precipitated particles from the mixture; and removing the ketone solvent from the mixture, leaving a refined, coal-derived heavy carbonaceous material which is suitable for use in the production of high-grade carbon stocks such as needle coke, carbon fibers, high-purity carbon, etc., and for use as an impregnant or binder pitch.

14 Claims, 2 Drawing Sheets

PROCESS FOR REFINING COAL-DERIVED HEAVY CARBONACEOUS MATERIALS

This application is a continuation of application Ser. No. 037,999, filed Apr. 14, 1987, which is a continuation of Ser. No. 832,704, filed Feb. 25, 1986, both now abandoned.

BACKGROUND OF THE INVENTION

1. Field of the Invention

The present invention relates to a process for refining coal-derived heavy carbonaceous materials such as pitch and the like, and more particularly to a process for refining coal-derived heavy carbonaceous materials so as to remove quinoline insolubles therefrom, thereby making the carbonaceous materials suitable for use in the production of so-called "high-grade carbon stocks" such as needle coke (which is readily graphitizable and is useful in making ultra high power graphitic electrodes), carbon fibers, high-purity carbon, etc., and for use as an impregnant or binder pitch.

2. Prior Art

In the past, various carbon stocks such as the above-mentioned high-grade carbon stocks, as well as activated carbon, carbon black, and isotropic carbon have been produced from a wide variety of raw materials including petroleum-derived heavy oils, coal-derived heavy oils, synthetic polymers, and wood cellulose. Of these, petroleum-derived heavy oils and coal-derived heavy oils have been used in much greater quantities because they are less expensive and give higher carbonization yields. In the production of carbon stocks, these heavy oils are typically utilized in the form of pitches such as tar pitches or petroleum pitches from which most of the distillable components have been removed.

Compared with petroleum-derived heavy oils, coal-derived heavy oils are advantageous in that they have a very low sulfur content and hence can achieve even higher carbonization yields. It is known, however, that coal-derived heavy oils contain slight amounts of quinoline insolubles which are composed predominantly of inactive or non-graphitizable carbonaceous matter and ashes, and that the presence of quinoline insolubles even in slight amounts has detrimental effects on the production of high-grade carbon stocks such as needle coke, carbon fibers, and the like.

For example, in the production of carbon fibers from tar pitch, quinoline insolubles present in the pitch may cause breaking of the extruded filament or blockage of the extrusion nozzle during melt spinning operation. When a coal-derived heavy oil is used as an impregnant, quinoline insolubles may cause blocking of pores of the porous body to be impregnated therewith, thereby inhibiting further impregnation or slowing down the impregnation speed. Furthermore, since quinoline insolubles exhibit inhibitory effects on graphitization of tar pitches, readily graphitizable needle coke cannot be produced from those tar pitches containing quinoline insolubles.

Thus, there is a need for a method of refining coal-derived heavy oils which can remove substantially all quinoline insolubles present therein in order to facilitate extensive use thereof in the production of high-grade carbon stocks, thereby decreasing the cost of such carbon stocks.

Many methods for removing quinoline insolubles from coal-derived heavy oils have been proposed in the art. Most of these methods involve heat treatment or solvent treatment of the heavy oils. However, these prior art refining methods for coal-derived heavy oils are generally unsatisfactory when they are performed on a commercial scale.

A commercially feasible refining process of coal-derived heavy oils is disclosed in Sunami et al. U.S. Pat. No. 4,402,824 (counterpart of West German Patent 3,112,004) which is incorporated herein by reference. The process comprises mixing a coal-derived heavy oil such as coal tar which has been freed of lighter components having boiling points up to at least 200° C. and not more than 270° C. with a ketone solvent such as acetone having a boiling point below 200° C. to precipitate quinoline insolubles as coarse particles, which are then easily removed from the supernatant liquid. The ketone solvent is then readily recovered from the heavy oil by distillation for recycling to the mixing step because of the relatively low boiling point of the solvent.

Unfortunately, the process of Sunami et al. U.S. Pat. No. 4,402,824 cannot be applied to the refining of heavier oils or heavier carbonaceous materials such as tar pitches from which at least some of the distillable components having boiling points above 270° C. such as anthracene oil have been removed in addition to those having boiling points of up to 270° C., since it is difficult to uniformly mix such heavier materials with the ketone solvent for refining. More specifically, since such heavier materials are normally solid at room temperature, it takes a long period to mix them with the ketone solvent substantially completely. In addition, during the mixing, sticky gum substances are often formed, and these stick to the walls of the mixing equipment or piping, thereby interfering with smooth and continuous mixing. Furthermore, the gum substances cannot be readily removed by conventional separating techniques such as sedimentation, centrifuging, or filtration.

Thus, the process of Sunami et al. is essentially limited to the refining of coal-derived heavy oils from which only lighter components having boiling points of at most 270° C. have been removed. In order to use such a refined heavy oil in the production of carbon stocks by a process which involves carbonization, it must usually be converted to a much heavier material such as a pitch prior to the carbonization step by removing at least some of the distillable components boiling above 270° C. (the so-called "middle and heavy distillates") of the oil by any suitable means such as distillation or polymerization into higher molecular weights. The distillation or polymerization, however, often causes re-formation of undesirable quinoline insolubles, and in such cases the resulting heavier material such as pitch must be refined again so as to be free from quinoline insolubles.

Therefore, it is highly desirable to refine a coal-derived heavy oil to remove quinoline insolubles after it has been freed of at least some of the distillable components boiling above 270° C. such that the refined material can be directly used in the production of high-grade carbon stocks without distillation or polymerization, and further refining.

Accordingly, it is an object of the invention to provide a process for refining coal-derived heavy carbonaceous materials which is commercially feasible and which can be successfully applied to those coal-derived heavy carbonaceous materials from which all the components boiling at 270° C. or below and at least some of the components boiling above 270° C. have been removed.

It is another object of the invention to provide a process for refining such carbonaceous materials by means of solvent treatment to remove quinoline insolubles as readily-separable coarse precipitates.

It is a further object of the invention to provide a process for refining such carbonaceous materials so as to yield a refined material suitable for use in the production of high-grade, high-purity carbon stocks.

It is a still further object of the invention to provide a process for refining such carbonaceous materials by means of solvent treatment using a solvent capable of being readily mixed with the carbonaceous materials and of being readily removed therefrom.

SUMMARY OF THE INVENTION

It has been found that a low-viscosity ketone solvent can be satisfactorily mixed with a coal-derived heavy carbonaceous material from which all the components having boiling points below 270° C. and all or part of the components having boiling points ranging from 270° C. to 360° C. have been removed when adequate heat and, as required, pressure are applied to the normally solid carbonaceous materials only prior to or during the mixing. Also, it has surprisingly been found that after the temperature of the mixture drops toward room temperature by mixing a heated carbonaceous material with a cold ketone solvent or cooling the heated mixture or allowing it to cool to room temperature, the mixture of the heavy carbonaceous material with the ketone solvent still remains in the form of a low-viscosity fluid in which non-sticky, coarse, insoluble particles containing quinoline insolubles are precipitated, and no sticky gum substances are formed in the cold mixture at room temperature. Therefore, the coarse insoluble particles can then be readily separated from the cold mixture still in the form of a low-viscosity fluid without need of heat and/or pressure being applied again to the mixture during separation.

This result is entirely unexpected, since in the above-mentioned prior art, the same mixing when conducted at room temperature causes the formation of troublesome, sticky gum substances rather than readily-separable, non-sticky coarse particles. From the prior art, it is anticipated that even if the heavy carbonaceous material or its mixture with a ketone solvent is heated to facilitate mixing, the resulting mixture of the carbonaceous material with the ketone solvent after cooled to room temperature contains some sticky gum substances as found in mixing at room temperature. In view of the fact that in the prior art it is difficult to mix the same material with the ketone solvent at room temperature, it is also unexpected that the resulting mixture after cooled to room temperature still remains in the form of a low-viscosity fluid, thereby enabling the subsequent separation of coarse particles without need of heating and/or pressurizing.

In a broad aspect, the present invention resides in a process for refining coal-derived heavy carbonaceous materials which comprises the steps of:

providing a coal-derived heavy carbonaceous material from which all the components having normal boiling points of 270° C. or below and all or part of the components having normal boiling points ranging from 270° C. to 360° C. have been removed;

heating the heavy carbonaceous material to a temperature which is not lower than 40° C. and which is sufficiently high to make the material fluid;

mixing the heated carbonaceous material with a ketone solvent at atmospheric pressure or under pressure for a period sufficient to precipitate coarse insoluble particles in the mixture, the ketone solvent having a normal boiling point of not higher than 200° C. and being used in such an amount that the weight ratio of ketone solvent to carbonaceous material is within the range of from 0.5:1 to 3.0:1;

separating the precipitated particles from the mixture; and removing the ketone solvent from the mixture by a suitable means such as distillation, leaving a refined, coal-derived heavy carbonaceous material as the residue.

DETAILED DESCRIPTION OF THE PREFERRED EMBODIMENTS

The boiling points mentioned herein indicate normal boiling points, i.e., those at atmospheric pressure unless otherwise specified.

The present invention will be described in more detail while referring to the embodiments shown in the accompanying drawings.

Figure 1:
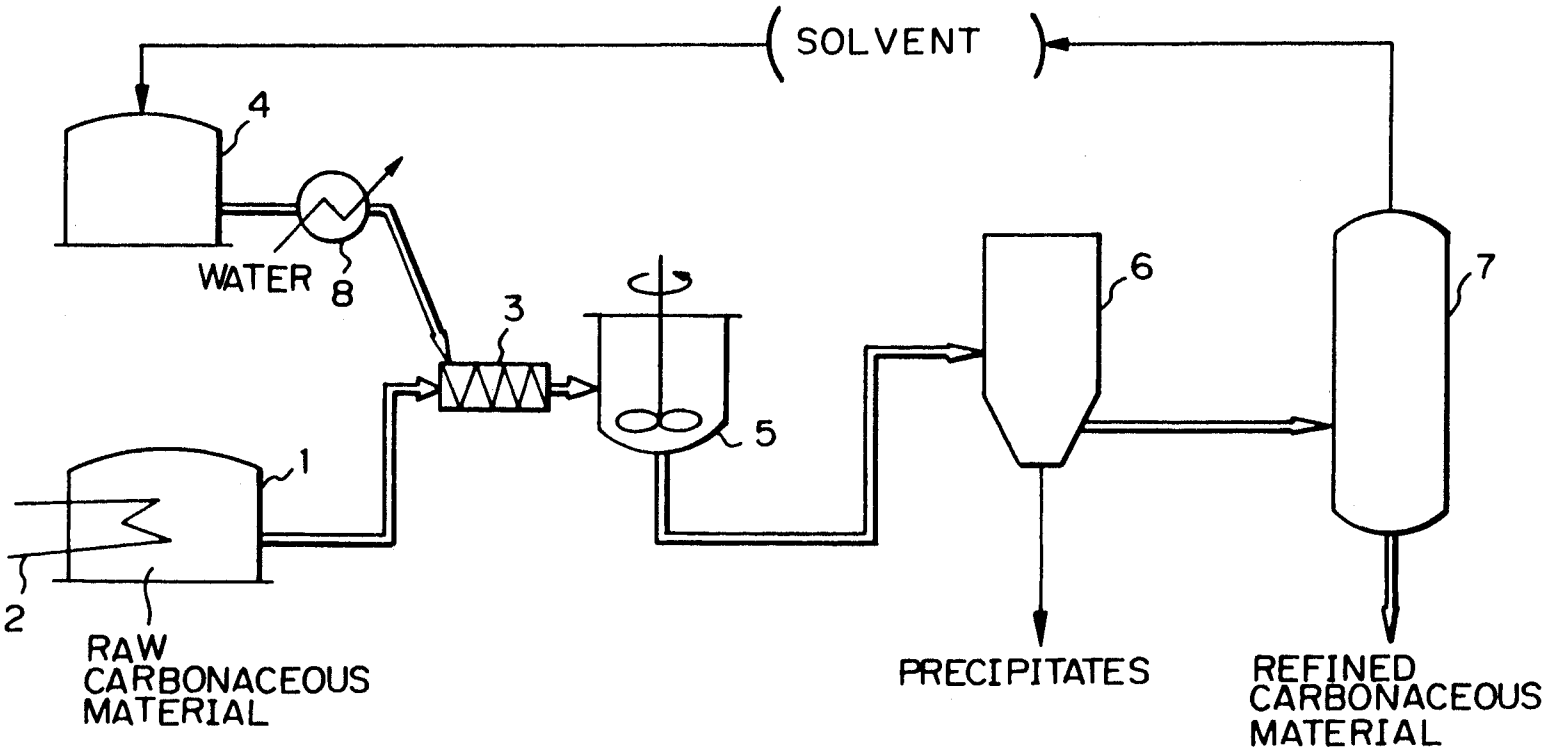
FIGS. 1 and 2 show schematic flow charts of different embodiments of the process of the present invention.

As shown in FIG. 1, a coal-derived heavy carbonaceous material is contained in a heated tank 1 and heated therein by an electric heater 2, for example, to a temperature which is not lower than 40° C. and which is sufficiently high to melt the material or make it fluid. If the temperature is below 40° C., it will be rather difficult even under pressure to mix completely with the ketone solvent in the subsequent step.

The heated heavy carbonaceous material is then mixed with a ketone solvent in a closed mixer to avoid the escape of vapor of the relatively volatile ketone solvent. In the embodiment shown in FIG. 1, the heated heavy carbonaceous material is passed to a heated and sealed static tubular-type mixer 3 where it is mixed with a ketone solvent supplied from a solvent storage tank 4 with heat and pressure being applied to the mixer 3. The temperature and the pressure applied to the mixer 3 are selected so as to form a low-viscosity fluid, and they depend on various factors including the particular carbonaceous material, particularly its softening point, the particular ketone, and the relative amounts and temperatures of the supplied materials. In some instances, application of heat and/or pressure in the mixer 3 may be omitted.

The resulting hot mixture in the form of a low-viscosity fluid is then agitated in a closed agitation tank 5 which is operated at atmospheric pressure without heating. Agitation of the mixture may be carried out by an agitator or by circulating the mixture in the tank 5. During mixing in mixer 3 and agitation tank 5, coarse insoluble particles which contain quinoline insolubles are precipitated in the mixture. Particles which are sufficiently coarse to allow their ready separation are usually formed in the mixture within several minutes.

Although it has not been confirmed, it is believed, as discussed in the afore-mentioned Sunami et al. U.S. Pat. No. 4,402,824, that mixing of the heavy carbonaceous material with the ketone solvent initially causes precipitation of both sticky gum substances and fine particles of quinoline insolubles. As the mixing is continued, the fine particles of quinoline insolubles adhere to the sticky gum substances whereby the gum substances grow into coarse particles having the surfaces of non-sticky quinoline insolubles adhering thereto. The resulting coarse insoluble particles are therefore stable and have non-sticky surfaces so that they can readily be separated from the liquid mixture by a conventional technique such as decantation, centrifuging or filtration.

While agitated in the agitation tank 5 without heating, the temperature of the mixture drops toward room temperature. If desired, the mixture may be cooled by a suitable cooling means after mixing. The mixture which contains coarse, insoluble precipitates is then passed to a centrifuge 6 where the coarse precipitates are separated from the fluid mixture. Of course, such separation may be carried out by other equipment such as a decanter, settling tank, or filter.

The precipitate-free mixture is passed to a distillation column 7 where the ketone solvent boiling below 200° C. is distilled and recovered as the overhead flow and recycled to the solvent storage tank 4. If desired, the recycled ketone solvent may be cooled by a water cooler 8 or similar cooling device before it is mixed with the heated heavy carbonaceous material. The bottoms of distillation column 7 are the desired, refined heavy carbonaceous material which is substantially free from quinoline insolubles.

Figure 2:
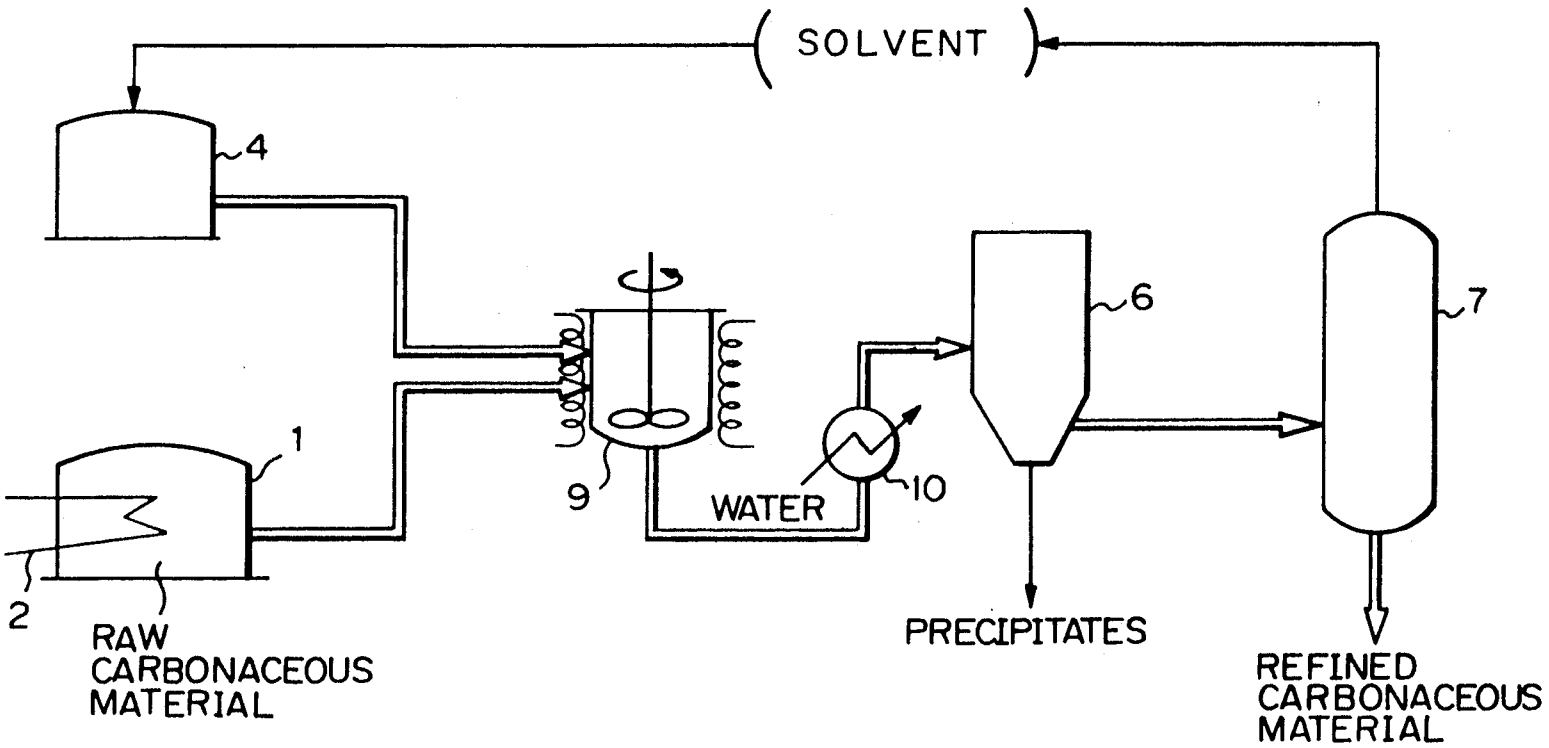

In another embodiment shown in FIG. 2, the heated coal-derived heavy carbonaceous material from a heated tank 1 and the ketone solvent from a tank 4 are mixed with agtitation in a pressure tank 9 which is heated by a suitable means such as a heating jacket or electric heater and maintained at superatmospheric pressure with nitrogen. After the mixture is agitated, it is cooled by a water cooler 10 or similar cooling device and then passed to a centrifuge 6 to remove the insoluble precipitates present therein. The precipitate-free mixture is thereafter processed in the same way as shown in FIG. 1. In the embodiment of FIG. 2, however, cooling of the recycled ketone solvent prior to feeding to the tank 9 is usually omitted.

As mentioned previously, the coal-derived, heavy carbonaceous materials to be refined according to the present invention are usually solid, non-fluid substances at room temperature which have been freed of at least some of the components having boiling points between 270° C. and 360° C. in addition to all the components having boiling points of 270° C. or below. Preferably, all the components boiling below 300° C., and more preferably below 320° C. are removed from the heavy carbonaceous material prior to refining. Such heavy carbonaceous materials may be derived from coal tars such as high-temperature coal tars and low-temperature coal tars both produced as by-products during carbonization of coal such as coke making, as well as from coal liquefied oils by removing those components having boiling points of at least 270° C. and at highest 360° C. by distillation, stripping, or similar means. Alternatively, removal of such components may be carried out by subjecting the coal tars or coal liquefied oils to thermal polymerization or polymerization in the presence of a polymerization promotor such as nitric acid, thereby sufficiently increasing the molecular weight of lower boiling components to provide a heavier material. If necessary, the resulting polymerized carbonaceous material may be distilled in the same manner as above. Such polymerization is conventionally employed in the production of binder pitches for use in the manufacture of carbon electrodes and coke.

As is familiar to those skilled in the art, the above-mentioned heavy carbonaceous material used in the present invention is generally obtained in the coal tar industry as a by-product called pitch which is the residue of a coal tar from which various valuable distillates including naphthalene (b.p. 218° C.), acenaphthene (b.p. 277° C.), anthracene (b.p. 320° C.), and carbazole (b.p. 355° C.) have been recovered by distillation. Any of such distillation residues or pitches available from the coal tar industry may be refined according to the process of this invention, as long as those components having boiling points exceeding 360° C. have not been removed therefrom to a substantial degree.

As mentioned above, the coal-derived heavy carbonaceous material used in the invention is previously freed of any components boiling at 270° C. or below and additionally at least some components boiling at 360° C. or below. In other words, the initial boiling point of the carbonaceous material to be refined is in the range of from 270° C. to 360° C. The use of such a heavy carbonaceous material affords the following benefits:

(1) When the ketone solvent is recovered by distillation from the mixture after the insoluble precipitates formed in the mixture are removed, the recovered ketone solvent is of high purity because of a large difference in boiling point between the ketone and the carbonaceous material so that the recovered solvent can be used repeatedly in the refining process for a long period. This markedly reduces the material cost of the process.

(2) Since the lighter oil components have been removed from the carbonaceous material prior to refining, only the heavier material usually called pitch which is the effective raw material for the production of carbon stocks need be refined. Thus, the volume of the material being refined can be decreased significantly, thereby increasing the capacity of the refining system and further increasing the economy of the process.

(3) As mentioned previously, prior to refining, lighter valuable components boiling below 360° C. such as naphthalene, acenaphthene, anthracene, and carbazole can be recovered from the coal tar or other coal-derived heavy oil in order to use in the synthesis of various chemical substances or other purposes, and the residue is used as the raw heavy carbonaceous material to be refined by the present process. In addition, the process of the invention may be similarly applied to polymerized coal tars or coal liquefied oils obtained by thermal polymerization or catalytic polymerization of these oils. Even if quinoline insolubles are formed during such polymerization, they can be almost entirely removed in the subsequent refining according to the present invention.

(4) The refined heavy carbonaceous material can be directly used for the production of various carbon stocks or as an impregnating agent or binder pitch without further removal of ligher components by distillation or polymerization. Such distillation or polymerization, as mentioned above, may involve re-formation of undesirable quinoline insolubles and therefore should be avoided after refining of the material when it is used for the production of high-grade carbon stocks.

When some of those distillable components having boiling points exceeding 360° C. in addition to all the components boiling at 360° C. or below are removed from the coal-derived heavy carbonaceous material prior to refining, the flow point of this heavy carbonaceous material is so high that it is necessary to melt it at a temperature as high as 200° C. or above. In addition, even if the ketone solvent is mixed with the carbonaceous material at an elevated temperature under pressure, it is difficult to drop the temperature and pressure of the resulting mixture beyond certain points so that the insoluble precipitates containing quinoline insolubles must be separated at a high temperature under pressure, which makes the separation equipment and operation much complicated. Furthermore, such excessive and prolonged heating of the mixture under pressure often causes the formation of undesirable, sticky gum substances. Thus, removal of those components boiling above 360° C. from the carbonaceous material prior to refining will involve significant disadvantages in the practice of the process of the present invention.

The ketone solvent used for the process of the invention should have a boiling point of 200° C. or below, preferably 150° C. or below, and more preferably 100° C. or below. The use of such relatively low boiling solvent allows the easy distillatory separation of the solvent in pure form from the refined heavy high boiling carbonaceous material and facilitates recovery and re-use of the solvent.

The ketone solvent useful in the process of the invention includes saturated and unsaturated ketones such as acetone, methyl ethyl ketone, isopropyl methyl ketone, methyl propyl ketone, diethyl ketone, pinacolone, isobutyl methyl ketone, diisopropyl ketone, methyl butyl ketone, butyrone (dipropyl ketone), methyl vinyl ketone, mesityl oxide, methyl heptanone, cyclopentanone, cyclohexanone, ethyl amyl ketone, hexyl methyl ketone, and various combinations thereof. Preferred ketones are acetone, and methyl ethyl ketone.

As illustrated in the Comparative Examples below, use of other common solvents such as aliphatic or aromatic hydrocarbons does not cause the precipitates to grow into non-sticky, coarse particles when mixed with the carbonaceous material to be refined.

The ketone solvent is used in an amount such that the weight ratio of ketone solvent to heavy carbonaceous material is within the range of from 0.5:1 to 3.0:1, and preferably within the range of from 0.7:1 to 2.5:1. If the ratio is less than 0.5:1, growth of the precipitated quinoline insolubles into coarse particles will occur only with difficulty and the ketone solvent will not be able to sufficiently produce the desired effects of decreasing the viscosity of the mixture and cooling it.

On the other hand, if the above ratio exceeds 3.0:1, the precipitated quinoline insolubles may be coarsened too rapidly, which is accompanied by a tendency toward the formation of undesirable, sticky gum substances. The resulting gum substances will adhere to the walls of the mixing equipment and piping, thereby causing operational troubles such as blockage of the piping.

Any mixing tank or equipment may be employed in the process of the invention as long as it is of a closed type and is pressure resistant. For example, an agitation tank may be used as shown in FIG. 2, or a combination of a static tubular-type mixer with a tank which is agitated or not agitated may be used as shown in FIG. 1. The mixing may be carried out with or without heating and at atmospheric pressure or under pressure. The contact of the ketone solvent with the carbonaceous material should be continued until the precipitated quinoline insolubles are grown into readily-separable, coarse particles, usually of at least 0.1 mm, preferably 0.2 mm in diameter. The contact time necessary for this purpose is usually at most several minutes.

The coarse insoluble particles containing quinoline insolubles formed in the fluid mixture settle rapidly in the mixture due to their large particle diameters and hence sedimentation or centrifuging may be used to completely remove these particles. In the case of filtration, the fluid can readily pass through the filter without clogging thereof again due to the large particle diameters, and rapid separation of the precipitates is therefore possible. Of course, a combination of these separation techniques may be employed.

Furthermore, as mentioned previously, the mixture of the heated, heavy carbonaceous material with the low-boiling ketone solvent after cooling to room temperature still remains in the form of a low-viscosity fluid without formation of sticky gum substances. Therefore, the insoluble particles formed by the mixing step can be separated at the temperature of the cooled mixture at atmospheric pressure without need of further heating and/or pressurizing. This simplifies the separation procedure and equipment to advantage.

The following Examples and Comparative Examples are given to demonstrate the effects of the present invention. It should be understood that the Examples are merely illustrative and are not intended to limit the invention thereto. In the Examples and Comparative Examples, all the percents are by weight unless otherwise indicated.

EXAMPLES 1–4 AND COMPARATIVE EXAMPLES 1–4

Using the refining apparatus schematically illustrated in FIG. 1, the coal tar-derived heavy carbonaceous material heated to a predetermined temperature and the organic solvent at room temperature both indicated in Table 1 below were pumped into a static mixing tube at a predetermined mixing ratio. After passing through the mixing tube, the resulting mixture was introduced into a closed circulating tank and retained therein for 5 minutes for further mixing. Other mixing conditions, i.e., the mixing ratio, temperature of the heated, raw heavy carbonaceous material, and pressure in the mixing tube are also summarized in Table 1. Neither the static mixing tube nor the circulating tank was heated. After the 5-minute retention in the circulating tank, the mixture was passed to a continuous screw decanter operated at atmospheric pressure and at a rotational speed of 4000 rpm and retained therein for 2 minutes to centrifugally remove the insoluble precipitates formed in the mixture.

The insoluble precipitates which were removed were then washed with the same solvent as used in the refining to wash out the heavy carbonaceous material present on the surface of the precipitates. From the weight of the washed precipitates, the yield of the insolubles removed by the refining was calculated as a weight percentage based on the initial amount of the raw heavy carbonaceous material. This yield is also indicated in Table 1.

The fluid mixture remaining after removal of the insolubles was then distilled to remove the solvent, leaving the desired, refined heavy carbonaceous material as a residue. The content of quinoline insolubles present in the refined heavy carbonaceous material was determined according to the centrifugal method defined in JIS-K-2425. This content is also shown in Table 1.

As is apparent from the results shown in Table 1, each of the refined heavy carbonaceous materials obtained in Examples 1 to 4 was completely free from quinoline insolubles, indicating that the process of the invention is entirely effective for removal of undesirable quinoline insolubles from such heavy, raw, coal-derived carbonaceous materials.

In contrast, in Comparative Examples 1 and 2 wherein the solvents were benzene and kerosene, respectively, the insolubles formed by the mixing either still remained in the form of fine particles without coarsing, or became sticky gum substances. In such cases, it is very difficult to remove the precipitated insolubles by conventional techniques, thereby making commercial operation of the refining process difficult.

TABLE 1

| | Example 1 | Example 2 | Example 3 | Example 4 | Comparative Example 1 | Comparative Example 2 | Comparative Example 3 | Comparative Example 4 |
|---|---|---|---|---|---|---|---|---|
| Preparation of heavy carbonaceous material | Residue obtained by distillation of a coal tar to remove those components boiling at 300° C. or below | | Residues obtained by heat treatment of a coal tar at 450° C. for 3 hr followed by distillation to remove those components boiling at 350° C. or below | | Same as Examples 1 and 2 | | Residue after distillation at 200 Torr, 300° C. to remove those components of normal b.p. of 400° C. or below | Same as Examples 3 and 4 |
| Properties of heavy carbonaceous material (JIS-K2425) | | | | | | | | |
| Softening point (°C.) | 35 | | 65 | | 35 | | 140 | 65 |
| % Quinoline insolubles | 2.0 | | 5.4 | | 2.0 | | 5.8 | 5.4 |
| Solvent (b.p.) (Class) | Acetone (51° C.) (ketone) | | | | Benzene (82° C.) (aromatic hydrocarbon) | Kerosene (180–230° C.) (aliphatic hydrocarbon) | Acetone | Acetone |
| Weight ratio of solvent/heavy carbonaceous material | 0.8 | 1.2 | 1.2 | 2.0 | 1.2 | 1.2 | 2.0 | 1.2 |
| Mixing conditions | | | | | | | | |
| Temp. of heavy carbonaceous material (°C.) | 110 | | 150 | | 110 | | 200 | 25 (Note 1) |
| Pressure (kg/cm$^2$) | 10 | | 20 | | 10 | | 30 | Atmospheric |
| Visual appearance of insolubles (Coarse > 0.2 mm size) | Coarse | Coarse | Coarse | Coarse | Fine | (Note 2) | (Note 3) | (Note 4) |
| % Yield of insolubles | 5.4 | 6.7 | 7.7 | 9.6 | 2.0 | | | |
| % Quinoline insolubles in refined pitch | 0.0 | 0.0 | 0.0 | 0.0 | 0.5 | | | |

Note 1: The carbonaceous material was solid and pulverized before mixing with acetone.
Note 2: Sticky gum substances were formed in great amounts, stuck to tank and piping, and could not be separated.
Note 3: After the mixture reached 120° C. at 6 kg/cm$^2$, the temperature and pressure did not drop further, resulting in difficult centrifugal separation of the formed insolubles.
Note 4: Sticky gum substances were formed during mixing and they could not be centrifugally separated.

In Comparative Example 3 wherein a much heavier raw carbonaceous material derived from a coal tar which had been freed of some of the components having boiling points above 360° C. in addition to those boiling up to 360° C. was refined, it was necessary to heat the raw material at a very high temperature in order to make it sufficiently fluid and the temperature of the resulting mixture was still high even after the cold ketone solvent was mixed therewith. For this reason, in the subsequent separation of the insoluble precipitates, evaporation of the solvent and solidification of the residual pitch were observed. Thus, the insolubles could not be separated effectively, thereby making the refining difficult.

In Comparative Example 4 wherein the heavy carbonaceous material at room temperature was mixed with the ketone solvent at atmospheric pressure without previous heating to make it fluid, sticky gum substances were formed during the mixing step and hence subsequent separation of the precipitates by centrifuging or decantation was substantially impracticable.

Although the present invention has been been described with respect to preferred embodiments, it is to be understood that variations and modifications may be employed without departing from the concept of the invention as defined in the following claims.

What is claimed is:

1. A process for refining coal-derived heavy carbonaceous materials which comprises the steps of:

providing a coal-derived heavy carbonaceous material from which all the components having normal boiling points of 270° C. or below and all or part of the components having normal boiling points ranging from 270° C. to 360° C. have been removed;

fluidizing the resulting heavy carbonaceous material by heating it to a temperature not lower than 40° C.;

mixing the heated carbonaceous material with a ketone solvent at atmospheric pressure or under pressure for a period sufficient to precipitate coarse insoluble particles in the mixture, said ketone solvent having a normal boiling point of not higher than 200° C. and being used in such an amount that the weight ratio of ketone solvent to carbonaceous material is within the range of from 0.5:1 to 3.0:1;

separating the precipitated particles from the mixture; and removing the ketone solvent from the mixture, leaving a refined, coal-derived heavy carbonaceous material.

2. The process as defined in claim 1 wherein all the components having boiling points of 300° C. or below have been removed from the heavy carbonaceous material provided in the process.

3. The process as defined in claim 1 wherein all the components having boiling points of 320° C. or below have been removed from the heavy carbonaceous material provided in the process.

4. The process as defined in claim 1 wherein the ketone solvent has a boiling point of 150° C. or below.

5. The process as defined in claim 1 wherein the ketone solvent has a boiling point of 100° C. or below.

6. The process as defined in claim 1 wherein the weight ratio of ketone solvent to carbonaceous material is within the range of from 0.7:1 to 2.5:1.

7. The process as defined in claim 1 wherein the heavy carbonaceous material is derived from a coal tar.

8. The process as defined in claim 7 wherein the coal tar has been distilled or polymerized to provide the heavy carbonaceous material.

9. The process as defined in claim 1 wherein the heavy carbonaceous material is derived from a coal-liquefied oil.

10. The process as defined in claim 9 wherein the coal-liquefied oil has been distilled or polymerized to provide the heavy carbonaceous material.

11. The process as defined in claim 1 wherein the mixing step is carried out without heating.

12. The process as defined in claim 1 wherein the mixing step is carried out with heating for at least part of the entire mixing period.

13. The process as defined in claim 1 wherein the mixing is carried out under pressure.

14. A process for refining coal-derived heavy carbonaceous materials as defined in claim 1 wherein said separating of precipitated particles from the mixture is conducted at room temperature without heating the mixture.

* * * * *